US007607998B1

(12) United States Patent
Park

(10) Patent No.: US 7,607,998 B1
(45) Date of Patent: Oct. 27, 2009

(54) GOLD TEE AND METHOD OF MAKING

(76) Inventor: Inbong Park, 714 Clifton Ave., Apt. 114, Clifton, NJ (US) 07013

( * ) Notice: Subject to any disclaimer, the term of this patent is extended or adjusted under 35 U.S.C. 154(b) by 0 days.

(21) Appl. No.: 12/118,927

(22) Filed: May 12, 2008

(51) Int. Cl.
*A63B 57/00* (2006.01)

(52) U.S. Cl. ..... 473/388; 473/387

(58) Field of Classification Search ..... 473/387–403; 229/932
See application file for complete search history.

(56) References Cited

U.S. PATENT DOCUMENTS 662,368 A * 11/1900 Wetzel ..... 473/388
1,551,636 A 5/1925 Bloom
1,554,321 A 9/1925 Banigan
1,604,390 A * 10/1926 Coker ..... 473/388
1,614,499 A 1/1927 Stirton
1,616,059 A * 2/1927 Mulvehill ..... 473/398
1,647,440 A * 11/1927 Fish ..... 473/388
1,661,513 A 3/1928 Swett
1,675,335 A 7/1928 Drevitson
1,730,046 A 10/1929 Stpw
2,011,203 A * 8/1935 Seiki ..... 473/396
2,032,783 A * 3/1936 Wood ..... 229/4.5
2,228,942 A * 1/1941 Balton ..... 426/139
2,440,473 A 4/1948 Hughes
2,747,768 A * 5/1956 Raines ..... 221/25
3,220,727 A * 11/1965 Legan ..... 473/386
3,487,443 A * 12/1969 Wise et al. ..... 229/400
4,418,916 A 12/1983 Matsuura
4,444,795 A * 4/1984 Weinstein ..... 426/90
4,976,431 A 12/1990 Guenther
4,978,021 A * 12/1990 Mini et al. ..... 220/8
5,016,918 A * 5/1991 Tidwell ..... 283/67
6,010,413 A 1/2000 Pan-Chung
6,110,059 A 8/2000 Haggarty
6,139,449 A 10/2000 Cardarelli
6,508,728 B1 * 1/2003 Colletti ..... 473/388
7,008,335 B2 * 3/2006 Kim ..... 473/391
7,041,338 B2 * 5/2006 Nigam ..... 427/407.1

* cited by examiner

*Primary Examiner*—Steven Wong
(74) *Attorney, Agent, or Firm*—Arthur Jacob

(57) ABSTRACT

A golf tee for supporting a golf ball has a generally conical, essentially hollow body in which a conoidal wall extends in an axial direction along a prescribed axial length between a ball support at an upper end of the body and a basal tip at a lower end of the body. The wall includes overlapping conoid layers of synthetic polymeric material, preferably located along a common spiral, with adjacent layers in sliding engagement with one-another, all of the layers having upper and lower edges at corresponding upper and lower ends of the body. Each layer is unsecured to an adjacent layer between corresponding upper and lower edges of the layers such that upon being struck by a blow transverse to the axial direction relative movement between adjacent layers will enable a resilient transverse deflection of the wall while essentially maintaining the prescribed axial length between the ball support and the basal tip. A method for making the golf tee includes winding a blank in the form of a semi-sector-like sheet of synthetic polymeric material into a spiral configuration to establish the generally conical, essentially hollow body.

11 Claims, 5 Drawing Sheets

GOLD TEE AND METHOD OF MAKING

The present invention relates generally to the game of golf and pertains, more specifically, to a golf tee and a method for making the golf tee.

The game of golf has enjoyed ever-increasing popularity, and golf-related items and equipment continually are being developed in an effort to assist more and more players in improving their game. The golf tee is a basic piece of equipment utilized by all players and has been offered over the years in a myriad of constructions and configurations. However, the most prevalent golf tee currently in use is in the form of a simple wooden tee which is easily used and inexpensive enough to be expendable. Attempts at replacing the ubiquitous wooden golf tee with paper or plastic tees in various configurations have met with little success, primarily due to a lack of improved performance or unwarranted increased expense.

The present invention is directed to a golf tee which provides a significant improvement in performance while being relatively easy and inexpensive to manufacture and offering increased longevity for greater practicality. As such, the present invention attains several objects and advantages, some of which are summarized as follows: Provides a golf tee having a construction which enables improved performance in that any tendency for interference with a full golf swing during a tee-off is greatly reduced; reduces any tendency for the golf tee to interfere with the desired trajectory of a golf ball driven off the tee; enables repeated uses of the golf tee, thereby reducing the need for frequent replacement and providing concomitant savings in the cost of game playing equipment; provides for compact storage and ease of carrying multiple golf tees; enables nested assembly of multiple golf tees for selecting a desired height of a teed golf ball above a ground plane; allows the economical manufacture of large quantities of durable golf tees constructed of relatively inexpensive material for consistent high quality and exemplary performance over a long service life; provides an aesthetically attractive golf tee which is easy to put into use for attaining better performance; decreases the expense of playing golf while facilitating better golf play; provides a simple device for increasing the pleasure derived from playing the game of golf.

The above objects and advantages, as well as further objects and advantages, are attained by the present invention which may be described briefly as a golf tee for supporting a golf ball in place at an elevated position above a ground plane, the golf tee comprising: a generally conical, essentially hollow body having a basal tip and a ball support spaced in an axial direction from the basal tip to establish a prescribed axial length between the ball support and the basal tip, the body including a conoidal wall having overlapping conoid layers of synthetic polymeric material extending axially between the basal tip and the ball support, each layer having a first edge at the ball support and a second edge at the basal tip, each layer being unsecured to an adjacent layer between corresponding first and second edges such that upon being struck by a blow transverse to the axial direction relative movement between adjacent layers will enable a resilient transverse deflection of the wall while essentially maintaining the prescribed axial length between the ball support and the basal tip.

In addition, the present invention provides a method of making a golf tee, the method comprising: winding a blank in the form of a semi-sector-like sheet of synthetic polymeric material into a spiral configuration to form a generally conical, essentially hollow body having a basal tip and a ball support spaced in an axial direction from the basal tip to establish a prescribed axial length between the ball support and the basal tip, with the body including a conoidal wall having overlapping conoid layers of synthetic polymeric material extending axially between the basal tip and the ball support, and each layer having a first edge at the ball support and a second edge at the basal tip, each layer being unsecured to an adjacent layer between corresponding first and second edges such that upon being struck by a blow transverse to the axial direction relative movement between adjacent layers will enable a resilient transverse deflection of the wall while essentially maintaining the prescribed axial length between the ball support and the basal tip.

The invention will be understood more fully, while still further objects and advantages will become apparent, in the following detailed description of preferred embodiments of the invention illustrated in the accompanying drawing, in which.

Figure 1:
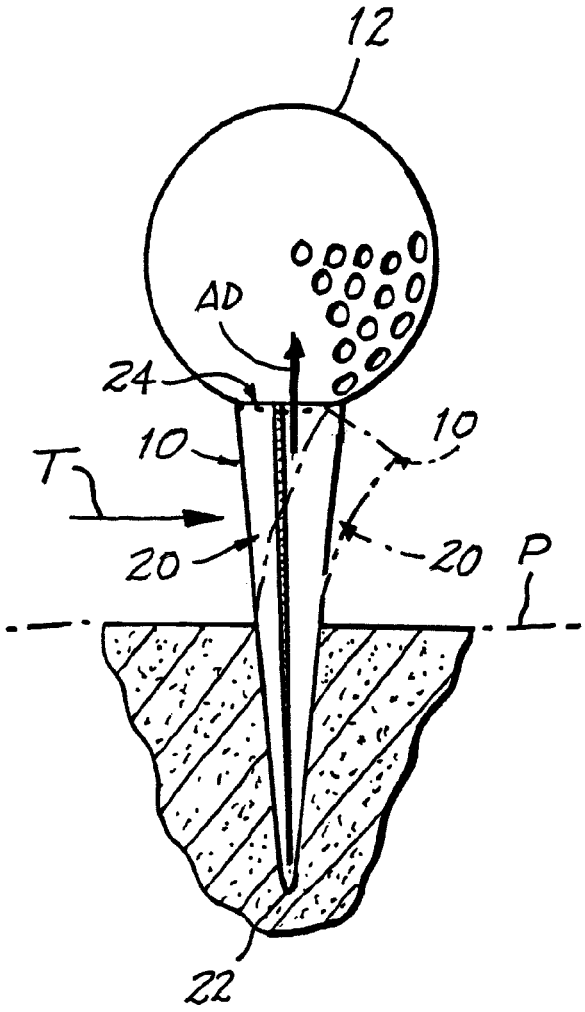
FIG. 1 is an elevational view illustrating a golf tee constructed in accordance with the present invention in use.
Figure 2:
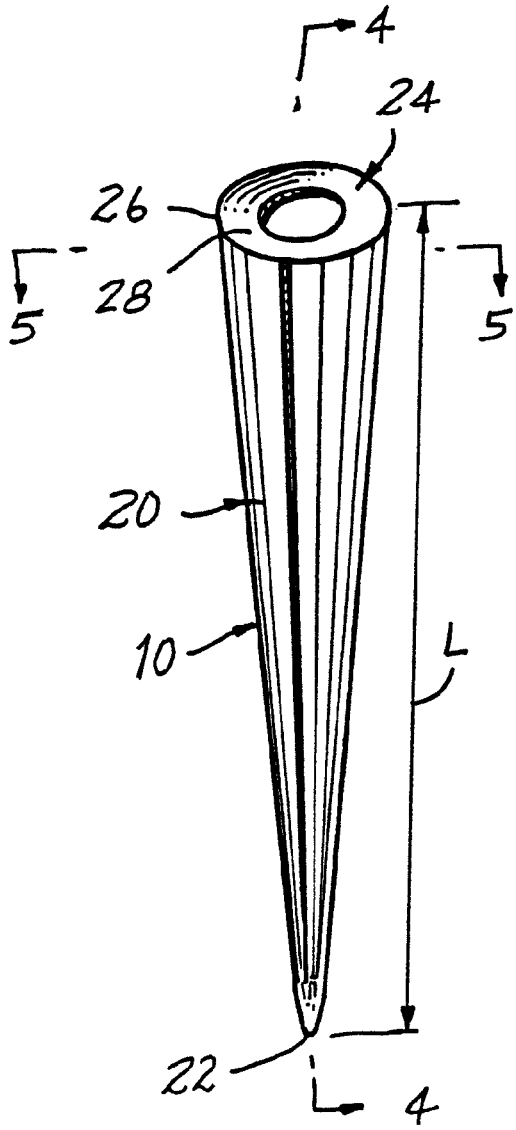
FIG. 2 is an enlarged pictorial view of the golf tee.

Referring now to the drawing, and especially to FIGS. 1 and 2 thereof, a golf tee constructed in accordance with the present invention is shown at 10 and is seen supporting a golf ball 12 in place at an elevated position above a ground plane P, as is conventional when preparing to drive golf ball 12. Golf tee 10 has a generally conical body 20 which extends in an axial direction AD from a basal tip 22 to a ball support 24 spaced axially from the basal tip 22 to establish a prescribed axial length L. Ball support 24 is shown in the form of a ball support member 26 having a cup-shaped ball seat 28, the contour configuration of the ball seat 28 being essentially complementary to the spherical contour configuration of golf ball 12 for effective support of the ball 12.

Figure 3:
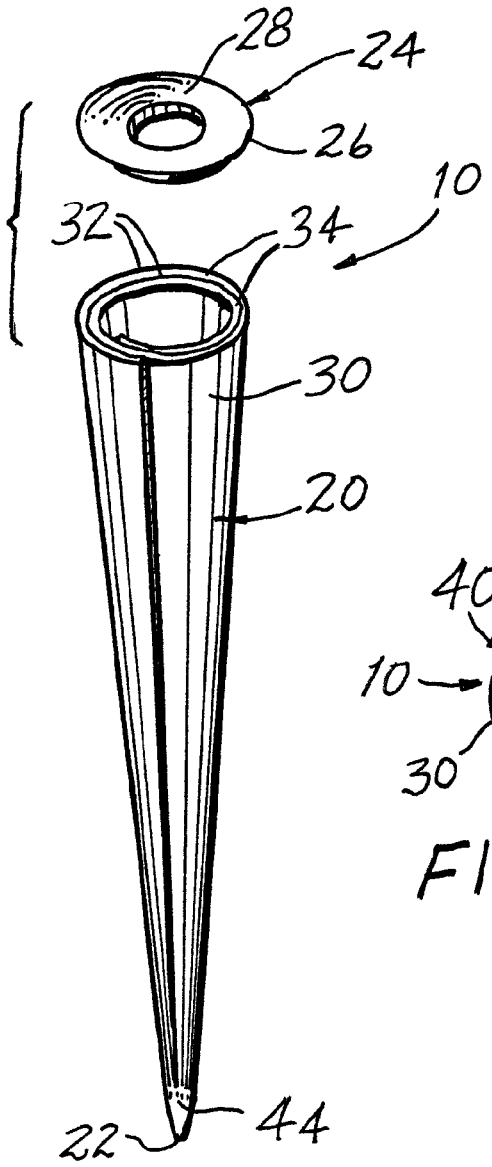
FIG. 3 is an exploded perspective view of the golf tee.
Figure 5:
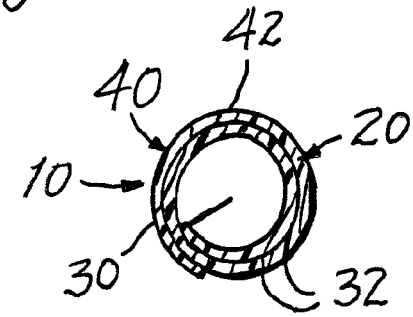
FIG. 5 is a transverse cross-sectional view taken along line 5-5 of FIG. 2.
Figure 4:
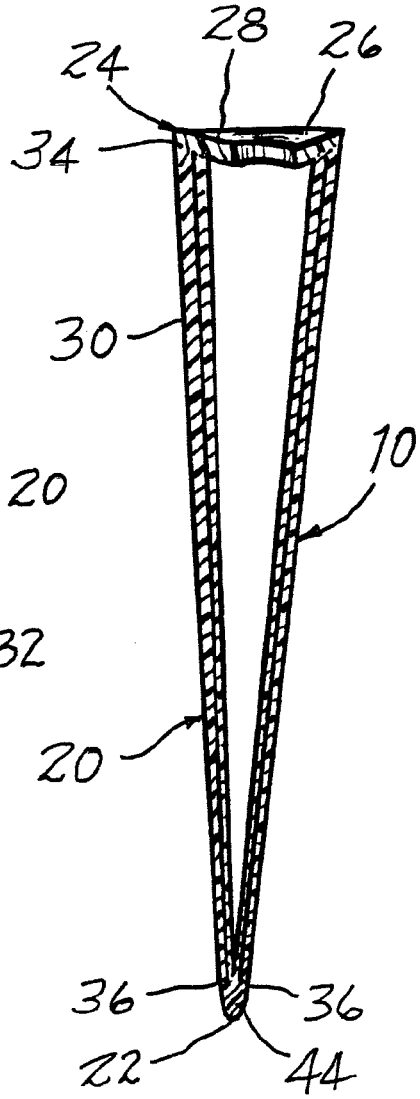
FIG. 4 is a longitudinal cross-sectional view taken along line 4-4 of FIG. 2.

Turning now to FIGS. 3 through 5, as well as to FIGS. 1 and 2, body 20 includes a conoidal wall 30 having overlapping conoid layers 32 extending axially between the basal tip 22 and the ball support 24. Each layer 32 has a first edge, shown in the form of an upper edge 34 at the ball support 24, and a second edge, shown in the form of a lower edge 36 at the basal tip 22. Wall 30 is constructed of a synthetic polymeric material, preferably in sheet form, having certain mechanical characteristics suited to the construction of golf tee 10, namely, a degree of resilient flexibility coupled with resistance to breakage upon impact, lubricity, and conformability, as will be described below. A preferred synthetic polymeric material is low density polyethylene sheet having a thickness of about 0.020 to 0.040 inch. In addition to possessing mechanical properties desired for golf tee 10, the material is available in a variety of colors, enabling the creation of aesthetically attractive golf tees 10.

In the preferred construction of body 20, a single sheet 40 of synthetic polymeric material follows a spiral configuration such that layers 32 extend along a common spiral 42 to establish a hollow conoidal body 20 having at least two overlapping layers 32. The layers 32 are joined together at the lower edges 36, as seen at 44, to establish an essentially pointed configuration at the basal tip 22. The upper edges 34 are joined together by virtue of the affixation of ball support 24 to the upper edge 34 of each layer 32. However, each layer 32 is unsecured to an adjacent overlapping layer 32 between corresponding upper and lower edges 34 and 36 such that upon golf tee 10 being struck by a transverse blow T, as often occurs upon driving a ball 12, relative movement between adjacent layers 32 of body 20 is allowed, enabling a resilient transverse deflection of the wall 30 of the hollow body 20, as indicated in phantom in FIG. 1, facilitated by the resilient flexibility of sheet 40 and the lubricity provided between adjacent layers 32, which are in sliding engagement with one-another, while the impact resistance of the material of sheet 40 militates against breaking apart of body 20. At the same time, joining of the layers 32 at the upper and lower edges 34 and 36 resists both contraction and extension of the axial length of the body 20 as the wall 30 of the body 20 flexes, thereby essentially maintaining the prescribed axial length L between the ball support 24 and the basal tip 22. Hence, any effect which the golf tee 10 might have upon the trajectory of the ball 12, in response to the golf tee 10 being struck as the ball 12 is driven from the tee 10, as a result of axial contraction or extension of the body 20 of tee 10, essentially is eliminated, while transverse flexing of the wall 30 of body 20 permits a full golf swing without significant interference which otherwise might result from striking the golf tee 10. Accordingly, golf tee 10 will remain intact for multiple reuses, and will enhance a golfer's performance by reducing or eliminating any interference which otherwise could affect the golfer's stroke or the trajectory of a driven ball.

Figure 6:
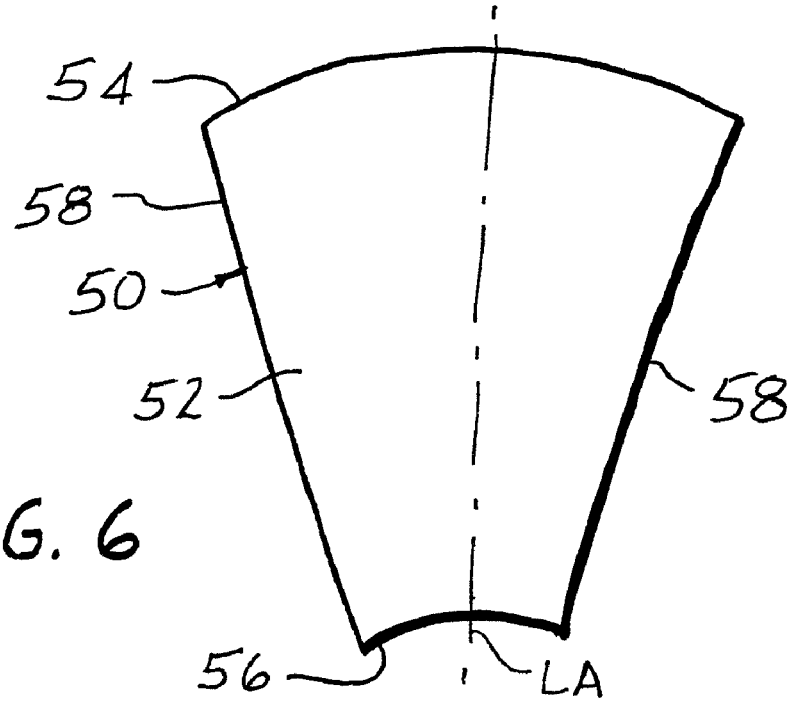
FIG. 6 is a plan view of a blank used to construct the golf tee.
Figure 7:
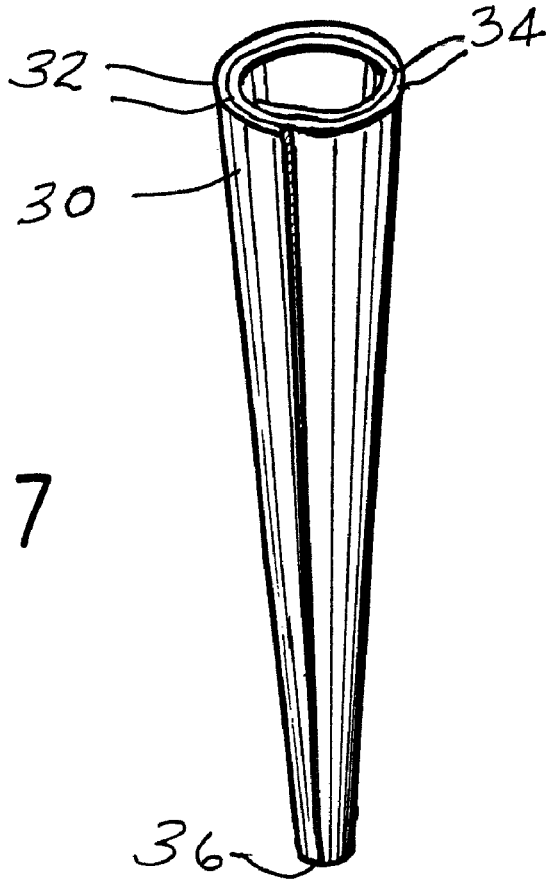
FIG. 7 is a perspective view showing a stage of construction of the golf tee.

Referring now to FIGS. 6 through 9, a method is illustrated for making golf tee 10. As seen in FIG. 6, a blank 50 in the form of a sheet 52 of synthetic polymeric material has a semi-sector-like plan configuration. In the preferred construction, sheet 52 is comprised of a low density polyethylene sheet having a first boundary in the form of an upper boundary 54, a longitudinally opposite second boundary in the form of a lower boundary 56, and laterally opposite side edges 58. The preferred thickness of sheet 52 is about 0.020 to 0.040 inch. Blank 50 is wound about a longitudinal axis LA into a spiral configuration, as illustrated in FIG. 7, and is heat-formed, or otherwise treated, to maintain the spiral configuration, thereby establishing the desired overlapping, slidably engaged layers 32 which are to provide wall 30 of body 20, with upper and lower edges 34 and 36, as described above in connection with FIGS. 1 through 5.

Figure 8:
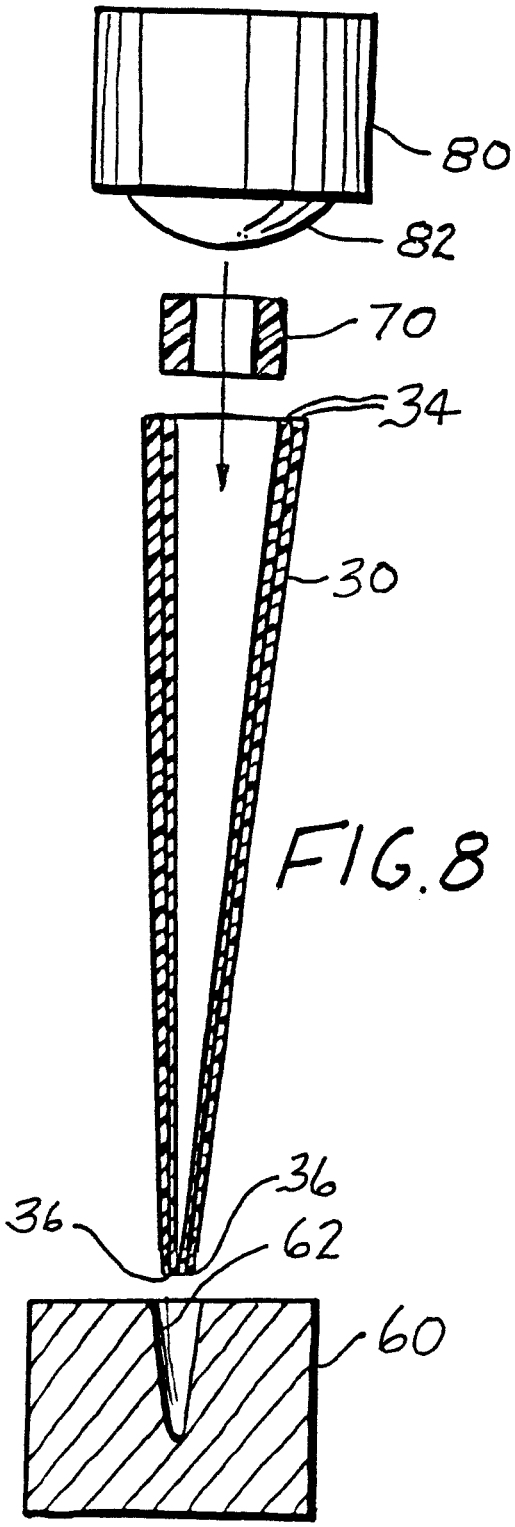
FIG. 8 is a diagrammatic elevational view showing another stage of construction.
Figure 9:
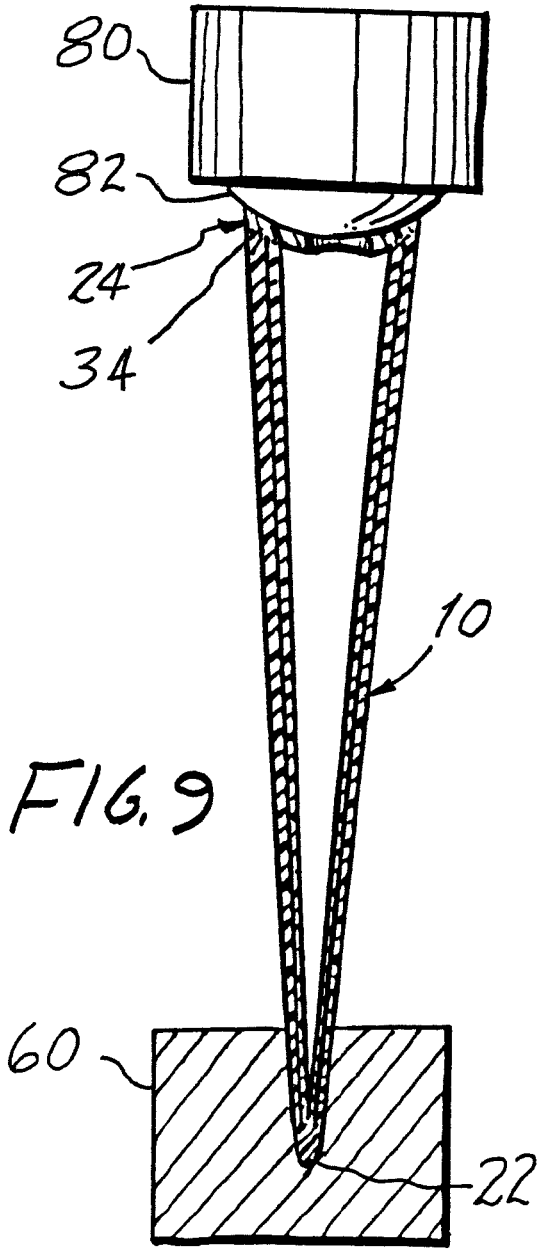
FIG. 9 is a diagrammatic elevational view showing a further stage of construction.

Then, as seen in FIGS. 8 and 9, a heated die 60 having a cavity 62 is engaged with the lower edges 36, and the lower edges 36 are fused together and formed by cavity 62 into the essentially pointed basal tip 22. In the preferred construction, a ring 70 of a thermoplastic synthetic polymeric material is placed at the upper edges 34 of wall 30, and a heated punch 80 having a semi-spherical face 82 dimensioned and configured to emulate the spherical configuration of golf ball 12 is engaged with the ring 70 to form the ring 70 into ball support member 26, which serves as ball support 24, and to affix the ball support member 26 to the upper edges 34, while at the same time joining together the upper edges 34 of adjacent layers 32 and completing the golf tee 10. Alternate procedures, such as those utilizing ultrasonic and laser welding techniques, are available for forming and joining the lower edges 36. Likewise, similar alternate procedures may be used to form ball support member 26 with ball seat 28, affix the ball support member 26 to wall 30, and join together upper edges 34 of adjacent layers 32. The aforesaid method is relatively simple and economical and enables the manufacture of large numbers of golf tees 10 of consistent high quality at relatively low cost.

Figure 10:
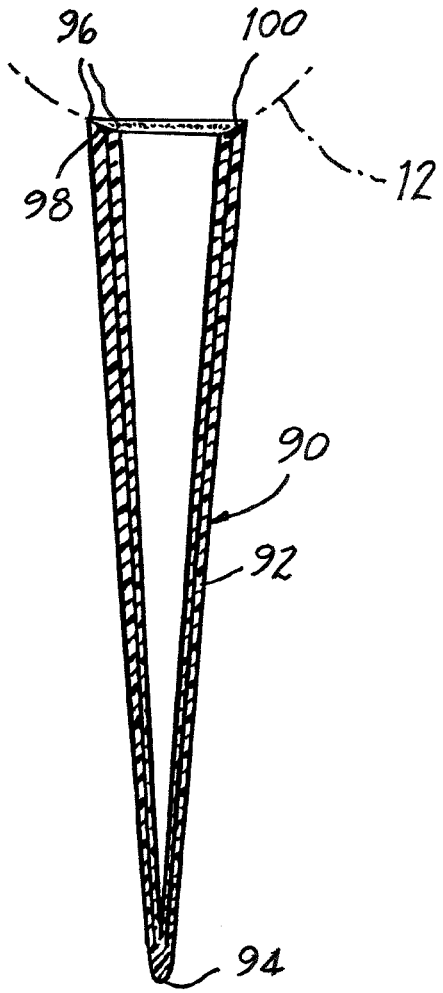
FIG. 10 is a longitudinal cross-sectional view similar to FIG. 4, and showing another golf tee constructed in accordance with the present invention.
Figure 11:
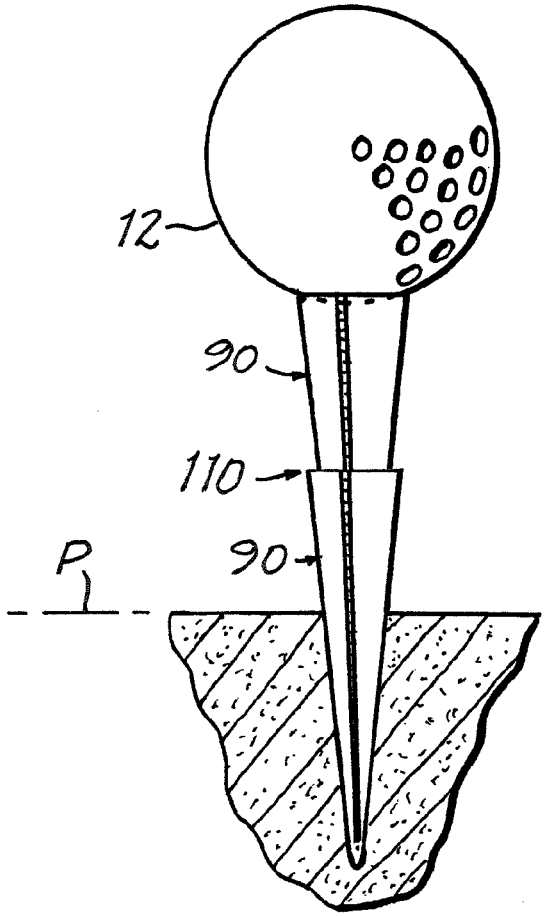
FIG. 11 is an elevational view similar to FIG. 1, and showing the golf tee of FIG. 10 placed in a golf tee assembly.

It is feasible to eliminate the use of a separate ring 70 for the formation of a ball support member 26, and merely to form the upper edges 34 into a ball seat configuration complementary to the spherical configuration of golf ball 12. Thus, as illustrated in FIGS. 10 and 11, a golf tee 90 is constructed similar to golf tee 10 insofar as golf tee 90 includes a conoidal wall 92 having overlapping conoid layers 94 extending axially between a basal tip 94 and upper edges 96. The upper edges 96 have been joined together at 98, utilizing heat or alternate joining techniques, as described above in connection with the construction of golf tee 10; however, in the construction of golf tee 90, the upper edges 96 have themselves been formed, as by heat or the like, into a ball support in the form of a ball seat 100 having a cupped configuration complementary to the spherical configuration of golf ball 12, as seen in FIG. 10, without the use of a supplemental ball support member, such as ball support member 26 of golf tee 10, thereby simplifying the construction of golf tee 90. Moreover, with such a construction, multiple golf tees 90 can be serially nested for compact storage and ease of carrying, as well as for establishing a selected height of the golf ball 12 above the ground plane P by joining a selected number of nested golf tees 90 into a single golf tee assembly 110 of desired length, as shown in FIG. 11.

It will be seen that the present invention attains all of the objects and advantages summarized above, namely: Provides a golf tee having a construction which enables improved performance in that any tendency for interference with a full golf swing during a tee-off is greatly reduced; reduces any tendency for the golf tee to interfere with the desired trajectory of a golf ball driven off the tee; enables repeated uses of the golf tee, thereby reducing the need for frequent replacement and providing concomitant savings in the cost of game playing equipment; provides for compact storage and ease of carrying multiple golf tees; enables nested assembly of multiple golf tees for selecting a desired height of a teed golf ball above a ground plane; allows the economical manufacture of large quantities of durable golf tees constructed of relatively inexpensive material for consistent high quality and exemplary performance over a long service life; provides an aesthetically attractive golf tee which is easy to put into use for attaining better performance; decreases the expense of playing golf while facilitating better golf play; provides a simple device for increasing the pleasure derived from playing the game of golf.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A golf tee for supporting a golf ball in place at an elevated position above a ground plane, the golf tee comprising:

a generally conical, essentially hollow body having a basal tip and a ball support spaced in an axial direction from the basal tip to establish a prescribed axial length between the ball support and the basal tip, the body including a conoidal wall having a spiral configuration including overlapping conoid layers of synthetic polymeric material extending axially from the basal tip to the ball support, each layer having a first edge at the ball support and a second edge at the basal tip, each layer being unsecured to an adjacent layer between corresponding first and second edges such that upon being struck by a blow transverse to the axial direction relative movement between adjacent layers will enable a resilient transverse deflection of the wall while essentially maintaining the prescribed axial length between the ball support and the basal tip.

2. The golf tee of claim 1 wherein the conoidal wall comprises a single sheet wound into the spiral configuration.

3. The golf tee of claim 2 wherein the synthetic polymeric material is heat-formed so as to maintain the sheet in the spiral configuration.

4. The golf tee of claim 2 wherein the spiral configuration of the conoidal wall comprises at least two overlapping layers.

5. The golf tee of claim 4 wherein adjacent overlapping layers are in sliding engagement with one-another.

6. The golf tee of claim 4 wherein each first edge comprises an axially upper edge and each second edge comprises an axially lower edge, and the overlapping layers are joined at the lower edges to establish an essentially pointed configuration at the basal tip.

7. The golf tee of claim 6 wherein the ball support comprises a ball support member having a cup-shaped seat, and the ball support member is affixed to the upper edges.

8. The golf tee of claim 7 wherein the synthetic polymeric material comprises a sheet of polyethylene.

9. The golf tee of claim 8 wherein the sheet has a thickness of about 0.020 to 0.040 inch.

10. The golf tee of claim 1 wherein the synthetic polymeric material comprises a sheet of polyethylene.

11. The golf tee of claim 10 wherein the sheet has a thickness of about 0.020 to 0.040 inch.

* * * * *